US006988901B2

(12) United States Patent
Ribeau et al.

(10) Patent No.: US 6,988,901 B2
(45) Date of Patent: Jan. 24, 2006

(54) CONNECTOR FOR PRINTED CIRCUIT SURFACE MOUNTING AND METHOD FOR MAKING SAME

(75) Inventors: Pascal Ribeau, La Mans (FR); Janvier Gassies, Nuille le Jalais (FR); Joel Houdayer, Mulsanne (FR); Rachel Chabirand, Le Mans (FR); Michael Klein, La Mans (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/474,176

(22) PCT Filed: Apr. 5, 2002

(86) PCT No.: PCT/FR02/01207

§ 371 (c)(1),
(2), (4) Date: Apr. 12, 2004

(87) PCT Pub. No.: WO02/082587

PCT Pub. Date: Oct. 17, 2002

(65) Prior Publication Data

US 2004/0161982 A1 Aug. 19, 2004

(30) Foreign Application Priority Data

Apr. 6, 2001 (FR) ..... 01 05068
Apr. 6, 2001 (FR) ..... 01 05069

(51) Int. Cl.
*H01R 12/00* (2006.01)

(52) U.S. Cl. ..... 439/79; 439/606; 439/736; 439/931

(58) Field of Classification Search ..... 439/79, 439/660, 736, 886, 931, 606
See application file for complete search history.

(56) References Cited

U.S. PATENT DOCUMENTS

| | | | | |
|---|---|---|---|---|
| 4,202,593 | A | 5/1980 | Abernethy et al. | 339/125 |
| 4,969,842 | A * | 11/1990 | Davis | 439/629 |
| 5,030,113 | A * | 7/1991 | Wilson | 439/80 |
| 5,088,009 | A * | 2/1992 | Harada et al. | 361/787 |
| 5,190,461 | A | 3/1993 | Oorui et al. | 439/63 |
| 5,584,713 | A | 12/1996 | Kato et al. | 439/188 |
| 5,980,273 | A | 11/1999 | Yong et al. | 439/79 |
| 6,200,146 | B1 * | 3/2001 | Sarkissian | 439/79 |

FOREIGN PATENT DOCUMENTS

| | | |
|---|---|---|
| EP | 0840396 A1 | 5/1998 |
| EP | 0871256 A1 | 10/1998 |
| EP | 0892468 A2 | 1/1999 |
| EP | 0918379 A2 | 5/1999 |

* cited by examiner

*Primary Examiner*—Tho D. Ta
(74) *Attorney, Agent, or Firm*—Harrington & Smith, LLP

(57) ABSTRACT

The invention concerns an input/output connector (10) comprising a first electrically insulating part (1), including at least a fixing element (2, 4) and at least a contact strip, and a second part (50) acting as housing, which partly covers the first part (1), the planar connecting surface (5) of the contact rib (7) being located substantially in the same plane as the lower surface (9) of the fixing element (2, 4), such that said plane defines the plane for fixing the connector. Said connector can further comprise a power contact. The method for making such a connector consists in metallizing the plastic material to form the contact strip on the first part.

16 Claims, 6 Drawing Sheets

CONNECTOR FOR PRINTED CIRCUIT SURFACE MOUNTING AND METHOD FOR MAKING SAME

FIELD OF THE INVENTION

The invention concerns an input/output connector, particularly for surface mounting on a printed circuit card, the connector comprising a first electrically insulating part, which has at least one fixing element and at least one contact, and a second part, which serves as housing and partially covers the first part, according to the preamble of claim 1. In addition, the invention concerns a process a process for manufacturing connectors that can be surface mounted, according to claim 14.

BACKGROUND OF THE INVENTION

Such connectors are preferably used in portable communication devices, such as mobile phones or analogous devices. Usually, such devices are very small and easy to handle, so that there is little space for input/output connectors (which are also referred to as I/O connectors), which, for this reason, are surface mounted on a printed circuit card according to the SMD (surface mounted device) technique. Such connectors constitute mechanical interfaces for the connection of various peripheral devices, such as, for example, data transmission modems. The connectors, the dimensions of which are very small, have to be positioned precisely during mounting on the printed circuit card. In addition, they have to withstand strong mechanical demands on the life of the mobile phone and, if need be, they have to establish a good electrical connection between the connector and a complementary connector.

It has thus turned out that the demands pointed out above can be well satisfied if the connection side of the connector coincides essentially with the plane of the printed circuit card. In addition, it is indispensable that the fixing surface of the connector be reproducible.

Known from the document U.S. Pat. No. 6,000,953 is an I/O connector that uses, for the precise positioning of the connector, two L-shaped, removable holding clips, which are placed on the sides and at each end of which a projection is cut out by stamping. During the mounting or positioning of it, only these two projections make contact with the printed circuit card, so that the connector can be mounted in place in a way that permits pivoting. During the pivoting, the lowest contact pin of the connector is the first to reach the surface of the card and, together with the projections, makes up a tripod that defines the connection face of the connector.

Here, it is particularly disadvantageous that, on account of the flexibility of the connector contact pins, there is a longitudinal inclination with respect to the card, which is sometimes large and sometimes small. In addition, the reproducibility of this connection face makes it necessary to have contact plugs that are very precise in terms of form and length. Very narrow tolerance ranges also have to be observed for the lengthwise positioning of the pins in the housing. This inevitably increases the production costs of such a connector. In addition, it needs to be mentioned that the heights of the projections, obtained by stamping, are subject to great variation. In the prior art, this imprecision is not noteworthy owing to the fact that the heights of the projections are small in relation to their spacing. However, these variations do become noticeable if narrow I/O connectors are involved (for example, connectors that support only a few connections), so that, as the longitudinal inclination increases, a lateral wiggle becomes noticeable. The holding clips, which would also be poorly or falsely mounted laterally, also reinforce this effect, this being able to arise, for example, from impurities that have slipped between the clip and the housing.

In addition, owing to the fact that the connector comprises several basic pieces, such as the two removable holding clips, the contact pins enclosed in the housing, the housing itself, and locking hooks, a large number of manufacturing steps are required and this also increases the production costs. In addition, these narrow contact pins are not designed for large electrical powers.

SUMMARY OF THE INVENTION

The object of the invention is to propose an input/output connector for surface mounting on a printed circuit card, the connector comprising a first electrically insulating part, which has at least one fixing element having a planar face and at least one contact lead with a planar connection face, and a second part, which serves as housing and partially covers the first part and which has a connection face that is reproducible in a very precise way, it being possible to position this connector in a simple way on a printed circuit card.

This problem is solved by the fact that the planar connection face of the contact lead is situated essentially in the same plane as the bottom planar face of the fixing element, this plane defining the plane for fixing the connector. Moreover, the fact that the contact lead corresponds to a metallization deposited on an insulating zone of the first part, which is not covered by the second part, also contributes to the solution of this problem.

An advantageous mounting of the invention is obtained by the fact that the first part is made up of a piece formed by a single injection molding and that the second part is partially molded on above the first part.

It is thus particularly advantageous that the first part, together with its elements, is made up of a single piece. After the molding, there occurs no possibility of movement or of shifting forward or backward between the elements of the first part. The sole precaution consists in precisely milling the casting mold of the first part, namely, here, the injection molds. With the help of computer numerically controlled (CNC) machines, this does not pose any problem. The second part fills in the empty spaces of the first part and, owing to this, reinforces it, this creating a sturdy mechanical unit (connector).

Another advantageous mode of realization of the invention is that according to which the first part can have, on each of the two sides of the connector, a fixing element, in each of which centering holes can be arranged.

Preferably, in accordance with a special mode of realization of the invention, the connector includes the means for supporting strong electrical currents by, for example, having at least one power module for the transmission of high electrical powers.

In accordance with this special mode of realization of the invention, the power module consists of a metallic center contact, a metallic spring contact, and a holding contact, these contacts being capable of being connected electrically to a printed circuit card by means of bands of metallized synthetic material.

The connector in accordance with the invention consists of a first electrically insulating part, which has at least one fixing element and at least one electrical contact, and a second part, which serves as housing and partially covers the first part. The horizontally extending, planar connection face of the rigid contact is situated essentially in the same plane as the bottom planar face of the fixing element, this plane defining the plane for fixing the connector.

The connector comprises solely two parts and possibly a power module. It is only the first part that determines, by means of an undetachable fixing element and an undetachable contact having the connection surface, the plane for fixing the connector. A special feature of the invention lies in the fact that the connector does not require any additional mounting clip or hook to ensure the positioning and the fixation. Above all, it is necessary to bring out the fact that, when the connector has several contacts, all the fixing surfaces are situated in exclusively one plane.

Other advantageous modes of realization of the invention are characterized by the fact that the power module consists of a median metallic contact, an elastic metallic contact, and a holding contact, these contacts being capable of being connected electrically to a printed circuit card by means of bands of metallized synthetic material and by the fact that the two bands of synthetic material, extending over the back face of the connector and belonging to the first part, become separated connection surfaces that are situated in the same plane as the connection faces of the rigid contacts.

A power module that is realized in this way can be used to charge the device connected to it, a good electrical connection being ensured.

Another mode of realization of the invention is characterized by the fact that the center contact of elongated form, corresponding to a symmetry of rotation, has a smaller diameter in the zone in front than in the zone in back, which has at least one section of spherical form, projecting toward the outside in order to ensure the electrical and mechanical connection of the center contact to the first band or lead.

Such a center contact prevents, on the one hand, the scraping of a metallized surface and, on the other hand, thus ensures, all else notwithstanding, a good mechanical mounting.

Another object of the invention is to propose a process for manufacturing a connector capable of surface mounting, this process involving low production costs.

This object is attained by a process for manufacturing a connector that can be surface mounted in which the following manufacturing steps are involved. First of all, the first part is injection-molded. This is followed by chemical activation of the surface of the first part and then by filling in injection molding by compression of the first part in the injection mold of the second part. Now, the second part is partially molded on above the first part. Afterwards, the connector is metallized, the metal adhering only to the surface of the first part that is left exposed. Finally, in accordance with the chosen variant of the invention, metallic elements of the power module are possibly introduced into their corresponding chambers.

Thus, for the injection molding of the second part, the same thermoplastic material is used as for the injection molding of the first part. A special feature of the invention consists in the activation of the surface of the first part. Above all, this makes it possible to deposit the metal and to cause it to adhere to the synthetic material, such as a thermoplastic material. The first part is introduced into the injection mold of the second part and is subjected to filling in injection molding by compression, so that the first part, during the second pass, is not moved. After this, the second part that is formed plays the role of a sturdy, electrically insulating housing, owing to the fact that the voids and the intermediate spaces of the first part are filled. During the metallization, the second part acts as a mask. On the second part itself, no trace of adhering metal remains owing to the fact that, in general, the synthetic material chemically bonds poorly to the metal. By contrast, on the exposed, activated surface of the first part, a deposition of metal is preferably carried out. Simultaneously, the second part brings about the mutual separation of the different metallized zones of the first part, so that the latter are not connected to one another electrically. Thus, there occurs the formation of dedicated conducting zones that can be used as contacts. These metallic zones thus have an underlying support that is stiff and rigid, specifically the first part, which undergoes deformation poorly or hardly at all under the effect of pressure. It is thus particularly advantageous that, for such connectors manufactured in accordance with the invention, no contact plug is used. Contact pins or contact springs are used solely for the power module. It is therefore possible to combine the advantages of the two technologies without increasing the costs.

BRIEF DESCRIPTION OF THE DRAWINGS

A preferred example of realization of the connector in accordance with the invention will be described in detail below with reference to the schematic drawing. Shown in the drawing are the following:

FIGS. 1 and 2 represent the input/output connector in accordance with the invention as viewed from above and viewed from below, both in perspective. The connector is preferably cast in two passes. In the course of a first pass, a first part 1, such as illustrated in FIG. 5, is formed and, in the course of a second pass, it is the second part 50, partially covering the first part 1, that is made. In order to obtain a better understanding, the elements of the first part are marked by the reference characters 1 to 49 and the elements of the second part by the reference characters starting with 50. Essentially visible in the view from above in FIG. 1 is the second part 50 of rectangular shape.

DETAILED DESCRIPTION

Figure 1:
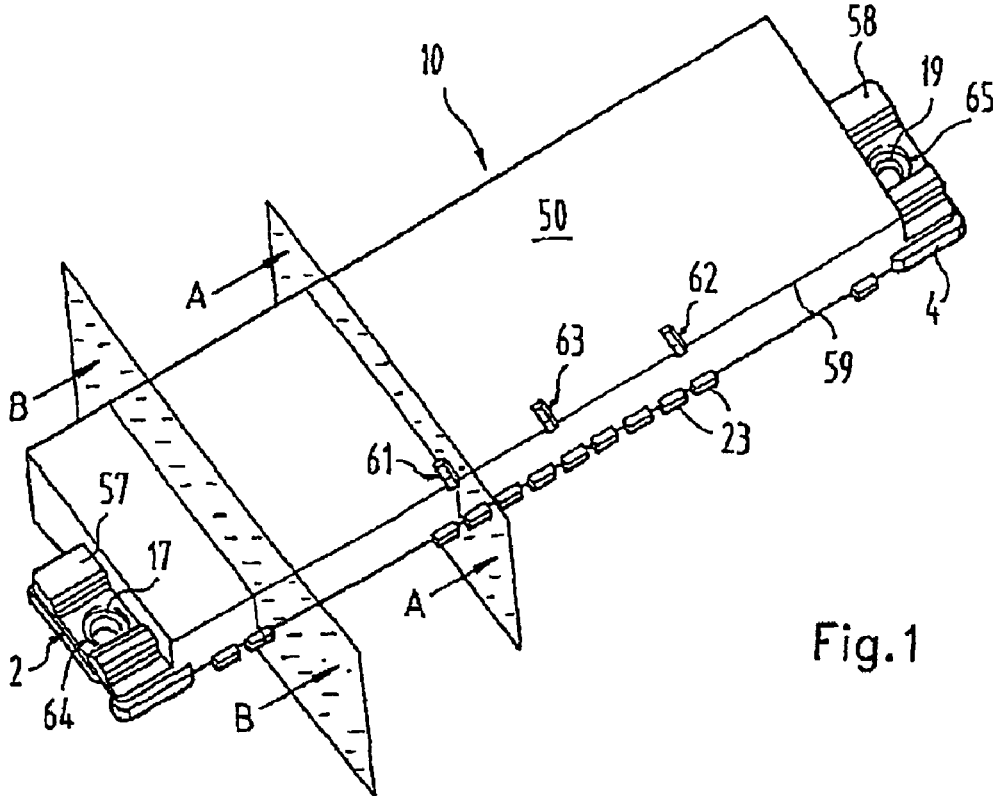
FIG. 1: a view from above in perspective of the connector in accordance with the invention.

The first part 1 and the second part 50 are preferably made of an insulating thermoplastic material. The connector includes at least one contact lead 3. This contact lead 3 is obtained by metallization on the surface of the first part 1. The metallization is carried out solely on the zones of the first part that have been activated beforehand and have been made capable of fixing a layer of metal.

This metallized surface includes at least one portion presented in a connection plane 5 that is essentially identical to a plane in which the fixing elements 2 and 4 are presented in the first part 1. The metallization obtained is of very small thickness and the molds that are used to form the first part 1 are designed in such a way that the subsequent addition of the metallization makes it possible to guarantee a coplanarity of the connection plane 5 with the plane of the fixing elements 2 and 4. For example, the plane of the fixing elements corresponds to the plane of the bottom faces 9 of these fixing elements 2 and 4. The bottom faces 9 and the faces presented in the connection plane 5 are situated in a single plane. At most, a divergence of 50 microns may exist between the plane of the bottom face 9 and the connection plane 5.

The first part 1 includes the contact ribs 7. A contact rib 7 is furnished so as to have, at its periphery, a contact lead such as 3. The fixing elements 2 and 4, together with their centering holes 6 and 8, respectively, are formed in one piece with the contact rib 7 during the molding of the first part 1. In order to obtain the desired coplanarity, the bottom faces 9 of the fixing elements 2 and 4, as well as the connection faces 5, are placed against a flat base of the injection mold of the second part. This thus guarantees that the molding on operation will not affect this coplanarity in that no deposition on these faces will take place in the course of this second pass.

The molding on of the second part 50 is carried out in such a way that the latter does not completely cover the first part 1. The activated zones of the first part 1 remain accessible and are thus capable of being metallized after the molding of the second part 50.

The second part 50 has a body of rectangular shape that is elongated on its two short sides by two projections 57 and 58. Formed in the center of each projection 57, 58 is a hole 64 and 65, respectively. Visible on a lower edge 59 of a top face of the body are three windows 61, 62, and 63 of rectangular shape. The holes 64, 65, as well as the windows 61 to 63, are produced by means of holding posts, coming from above, which press on the first part 1 at, for example, the level of the face 22, which is already molded so as to fix it in the injection mode of the second part 50. These holding posts permit the formation of the windows and holes. Indeed, at these places, no thermoplastic substance can be molded owing to this fact.

The fixing elements 2 and 4 of the first part 1 extend on the outside on these same short sides of the second part 50 in superposition with the projections 57 and 58. The centering holes 6 and 8 of the fixing elements 2 and 4 can be used for the positioning of the connector on the printed circuit card.

The connector is preferably organized according to a modular structure. It includes at least one contact module. A contact module includes at least one contact rib, such as 7, which is an electrical conductor. In a special first mode of realization, in FIG. 2, the first part 1 of the connector includes three contact modules. When the front of the connector is viewed from left to right, the first part 1 has a first contact module 14 having two contact ribs 7. There is then a second contact module 15 having nine contact ribs 7. Finally, there is a third contact module 16 having one contact rib 7.

The modules 14 to 16 are set in a frame 71 formed from a single piece on a fixing front. The contact ribs are arranged parallel to one another and include at least one second portion 11 that is perpendicular in relation to the direction of plugging.

Figure 3:
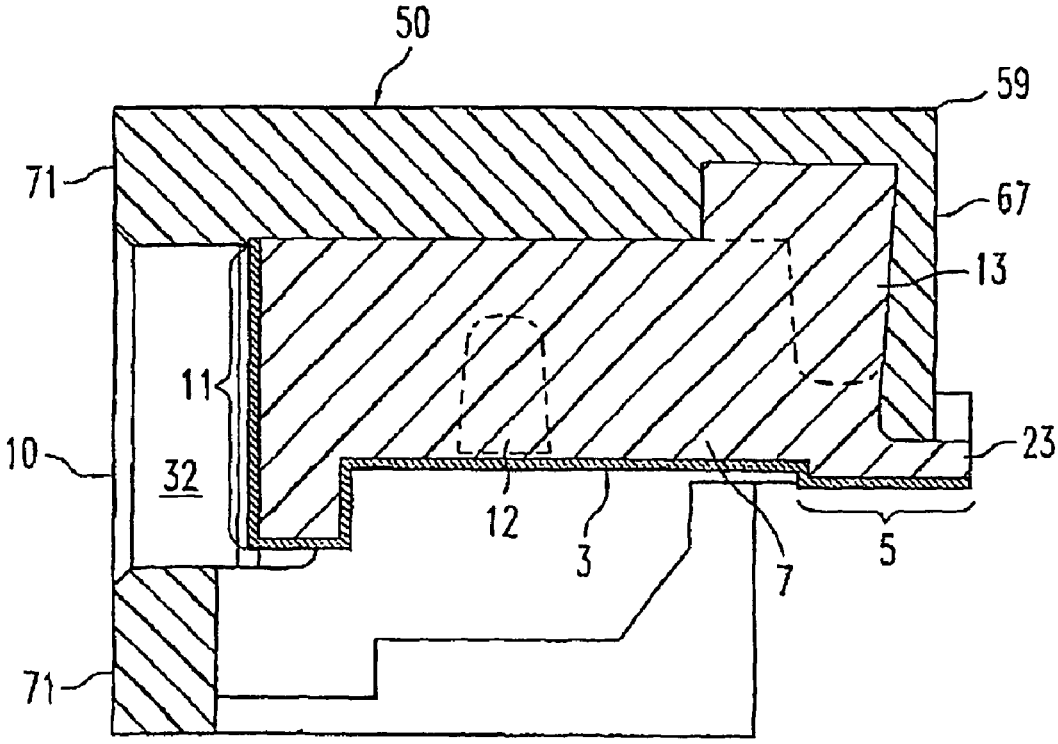
FIG. 3: a cross section along the plane B—B of FIG. 1.

FIG. 3 represents a section along the plane B—B of the connector of FIG. 1. The plane of the section B—B extends parallel to the direction of plugging and cuts a contact rib 7 in the longitudinal direction. The hatched zone, the hatch marks of which go toward the left in the upper part and toward the right in the lower part, indicate the second part 50. The frame 71 is visible on the exterior front of the connector 10 in the upper part and in the lower part. A receiving chamber 32, provided for receiving a contact of a complementary connector, is situated in an intermediate position. The hatched zone, the hatch marks of which go toward the left in the lower part and toward the right in the upper part, indicates the contact rib 7, which is an element of the first part 1. The bottom and front surfaces (at the left in the figure) of the rib 7 are not covered by the second part, so that the metallic contact leads 3 can be deposited there. These metallic leads 3 form the first portion, parallel to the bottom face of the connector, to be applied against a printed circuit card with which it can be connected. This first portion corresponds to the portion of metallized surface presented in the connection plane 5.

The metallic deposit is made over the entire length of the rib 7 in such a way as to form the contact lead 3. It is deposited on the surface of the front part of the contact, 11, essentially extending vertically on the figure, and on the surface of the back part of the contact, 5, essentially extending horizontally in the figure, which are provided for making the respective electrical contacts with the associated peripheral devices or complementary connectors and with the printed circuit card. The contact surfaces 5 and 11 are connected to one another by another portion of the contact lead 3.

It should be noted that the metallic deposit does not result in an increased thickness that modifies the dimensions of the rib 7. The contact is made up of an electrically conducting contact lead 3, which is applied to the uncovered surface of the contact rib 7 belonging to the first part 1, the zone, opposite to the exterior front 10, of the contact lead 3 forming the electrical connection surface 5 for the printed circuit card, and the zone, facing the exterior front 10, of the contact lead 3 forming the surface of electrical connection 11 for the associated peripheral device.

The ends 23 of the ribs 7 emerge from a lower part of a back face 67 of the body. Visible on the right in FIG. 4 is the end 23 of the rib 7, which passes through the back face 67 of the part 50.

Figure 4:
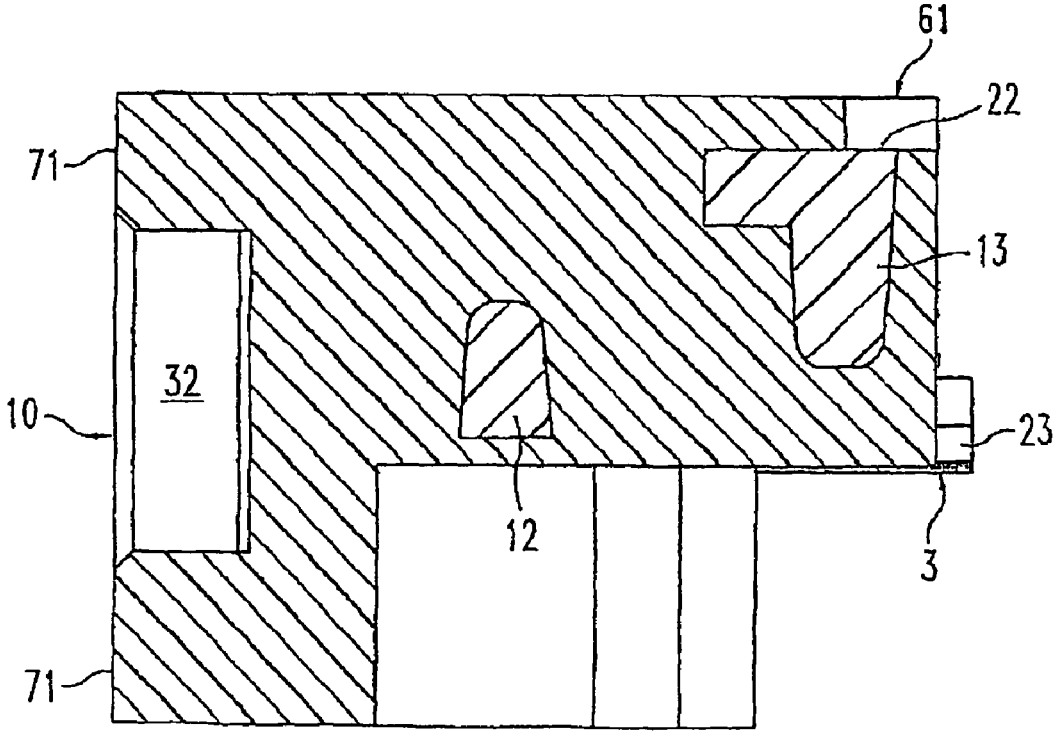
FIG. 4: a cross section along the plane A—A of FIG. 1.

FIG. 4 represents a section along the plane A—A of the connector of FIG. 1. The plane of the section A—A extends parallel to the direction of plugging, passes through a window 61, and then cuts at least one connecting element of the connector. Indicated in FIG. 4 by way of hatch marks are two connecting elements, a lower one and an upper one, 12 and 13, respectively, which make it possible to isolate the conducting leads, such as 3, and to connect the modules to one another. These connecting elements 12 and 13 serve as inserts between the ribs, such as 7. The hatch marks have the same meaning as in FIG. 3. The window 61 is visible on the right and on the left in FIG. 4. The upper connecting element 13, which is situated below, is fixed in the injection mold during the second pass by a holding post pressing downward from above. The post thus arrives at the upper edge 22 of the upper connecting element 13.

Figure 5:
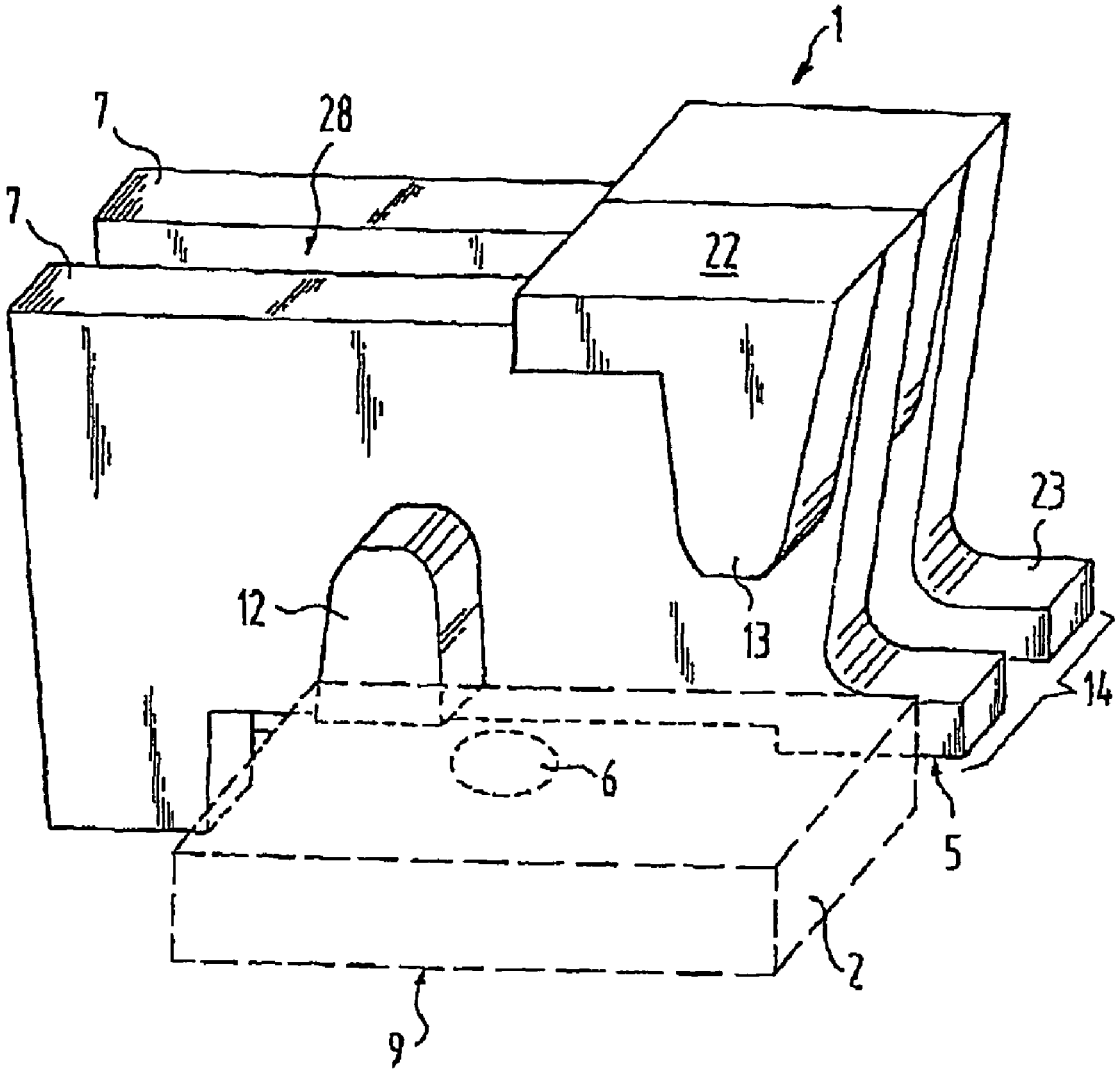
FIG. 5: a representation of a small zone of the first part without the second part added from below by mold casting.

FIG. 5 represents the first part directly after the first injection molding and only shows the first contact module 14. This module has two ribs 7 that extend parallel to each other. They are joined together mechanically by the two connecting elements 12, 13. The intermediate space 28 lying between them is filled in during the second molding pass by the material of the second part 50, which thus forms the shoulders 55.

Figure 2:
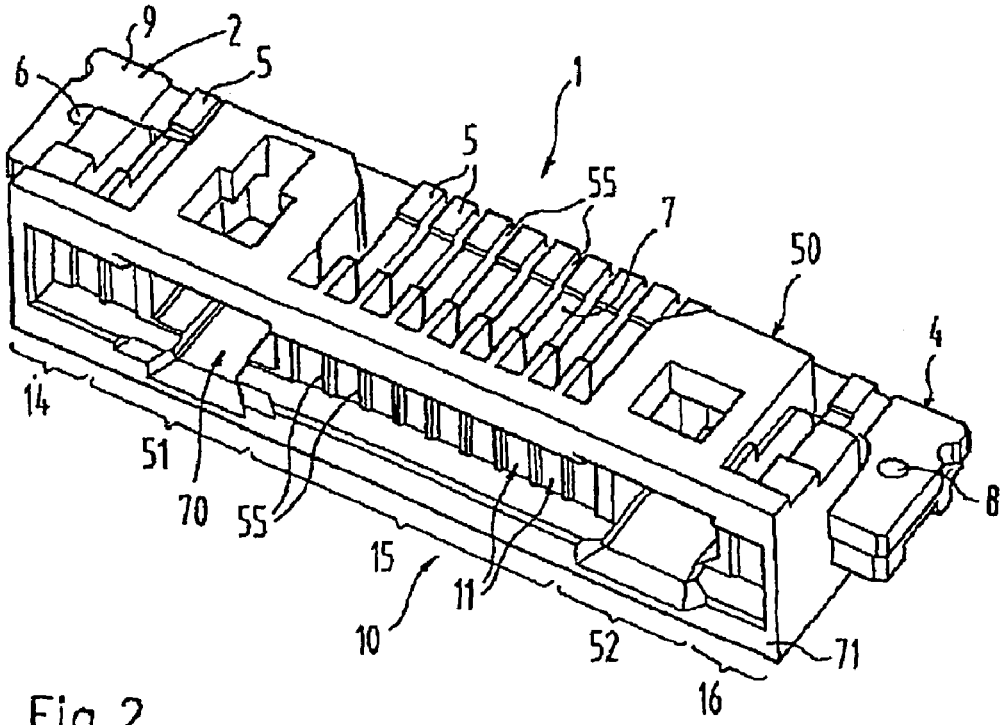
FIG. 2: a view from below in perspective of the connector in accordance with the invention, taken from FIG. 1.

In the mode of realization presented, the connector includes at least one means of locking. In FIG. 2, it includes two locking modules, a first module 51 and a second module 52. One locking module corresponds here to a seat 70 that is machined, or molded, in the second part 50, intended for locking hooks of the complementary connector, which is not represented. The second locking module 52 is formed identically to the first module 51 in the second part 50. The two locking modules 51 and 52 are distributed among the contact modules, preferably on either side of the second contact module 15.

In a variant presented through FIGS. 6 to 9, the contact module 14 is replaced by a power module 14, which does not include a rib, but does have a center contact 81, a spring contact 82, and a holding contact 83. In this variant in accordance with a special second mode of realization of the invention, the connector includes such a power module 14 to which is linked the first locking module 51. Provided afterwards is the second contact module 15, such as described in the preceding, furnished with nine contact ribs 7. The complementary second locking module 52, which, as presented here, evidently forms a cavity with a form different from that of the first module 51, comes next. Finally, the third contact module 16, itself furnished with two contact ribs 7, establishes the connection. In this variant as well, the modules 14 to 16 are set in the frame 71 formed in one piece on the front of the connector. The differences in form between the two locking modules 51 and 52 thus provide the connector with a means of proper alignment.

In this variant, the power module 14, to be described in more detail, will be attached. In order to realize such a connector, it is molded in two passes and the metallic elements, namely, the center contact 81, the spring contact 82, and the holding contact 83, are introduced into their corresponding chamber in the course of a final stage, after the metallization of the contact ribs, such as 7, has taken place. For reason of better understanding, the elements of the power module are represented by the reference characters numbered starting with 80.

Figure 7:
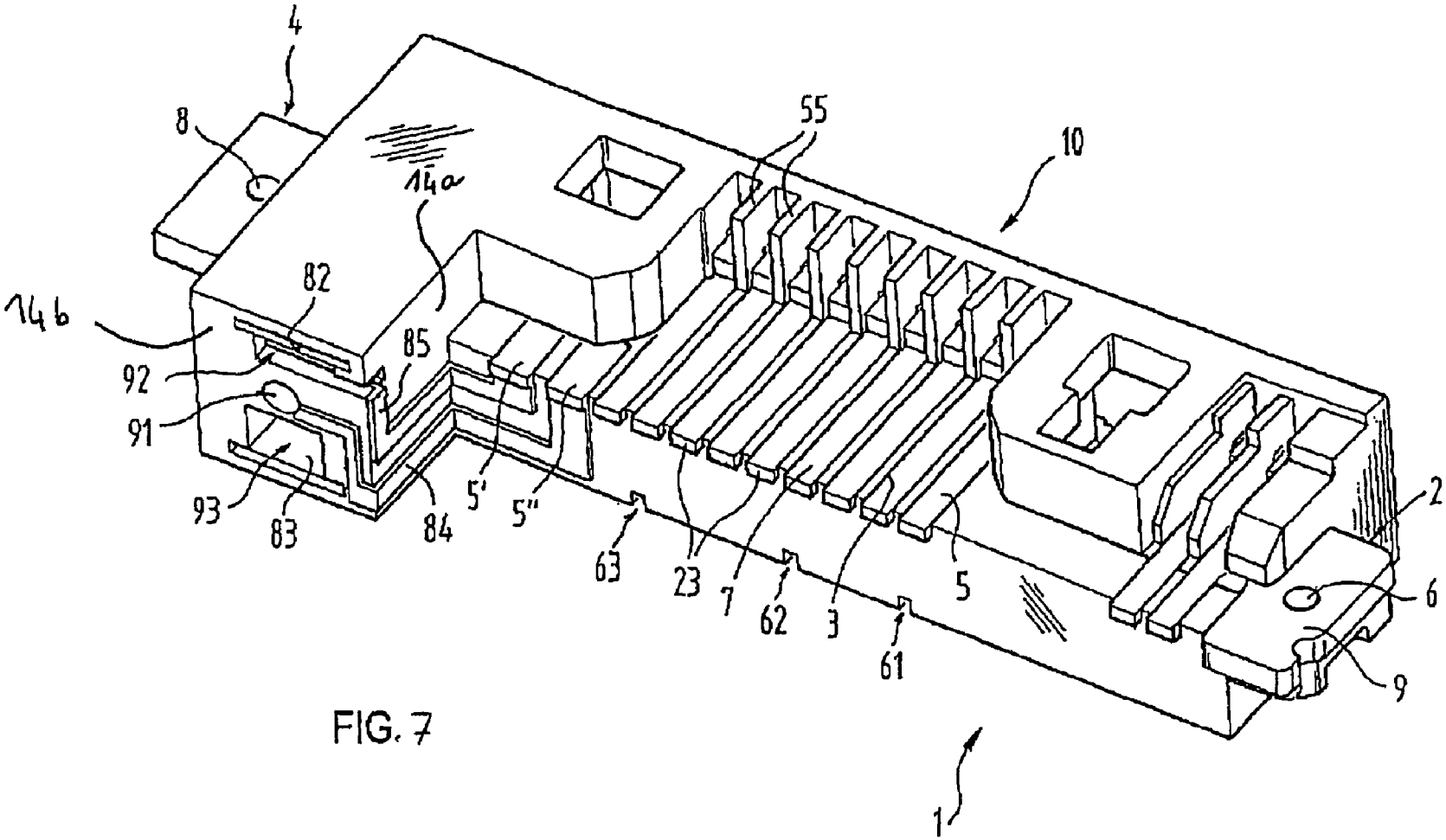
FIG. 7: a view from below in perspective of a special mode of realization of the connector of FIG. 6.

FIG. 7 shows the connector viewed from the back and viewed from below. Here, the ribs 7 extend parallel and are separated by the clearly visible shoulders 55. In FIG. 7, two connecting leads 5', 5" are arranged parallel to the contact ribs 7. They are elongated by the leads made of metallized synthetic material, 84, 85, in such a way that the contacts 81, 82 of the power module 14 are connected electrically to those connection faces 5', 5".

Figure 8:
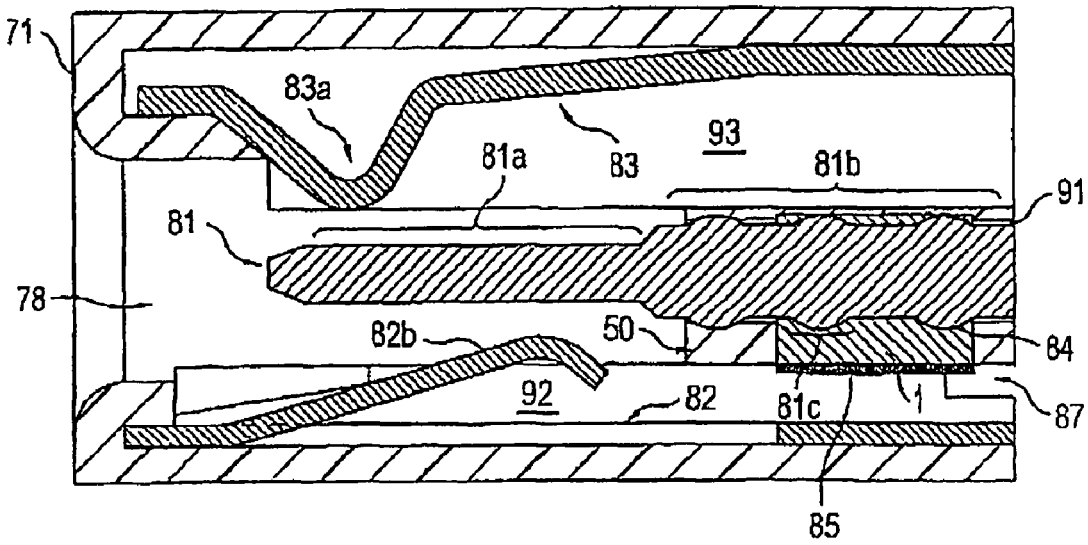
FIG. 8: a section view along the line F—F of FIG. 6.
Figure 9:
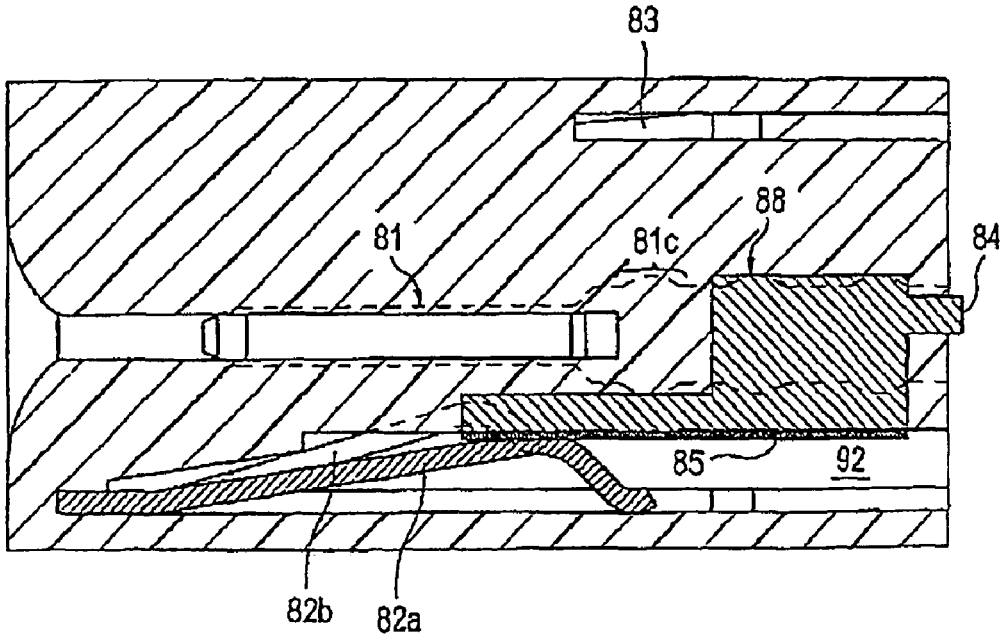
FIG. 9: a section view along the line G—G of FIG. 6.

In a back face 14*b* of the power module 14, on the right in FIGS. 8 and 9, are arranged a receiving chamber 92 for the spring contact 82, a receiving chamber 91 for the center contact 81, and a receiving chamber 93 for the holding contact 83.

Just as the ends 23 of the ribs 7 emerge in a lower part of the back face 67 of the body 56, the connecting leads 5', 5" also have ends emerging in the same way from the back face 67, all being aligned in relation to their corresponding connection contacts of a printed circuit card with which they can be connected. This makes it possible to obtain a secure and rapid brazing of the faces 5, 5', 5" with these contacts in a brazing oven by fusion.

On one lateral face 14*a* of the module 14, the first lead 84 of the center contact 81 extends first horizontally, then vertically, then horizontally on the back face 14*b* of the module 14, before the lead 84 disappears in the chamber 91. The second lead 85 of the spring contact 87 extends horizontally, then vertically on the lateral face 14*a*, before the second lead 85, passing through a window 87 arranged in the module 14, arrives in the chamber 92 of the spring contact 82.

Figure 6:
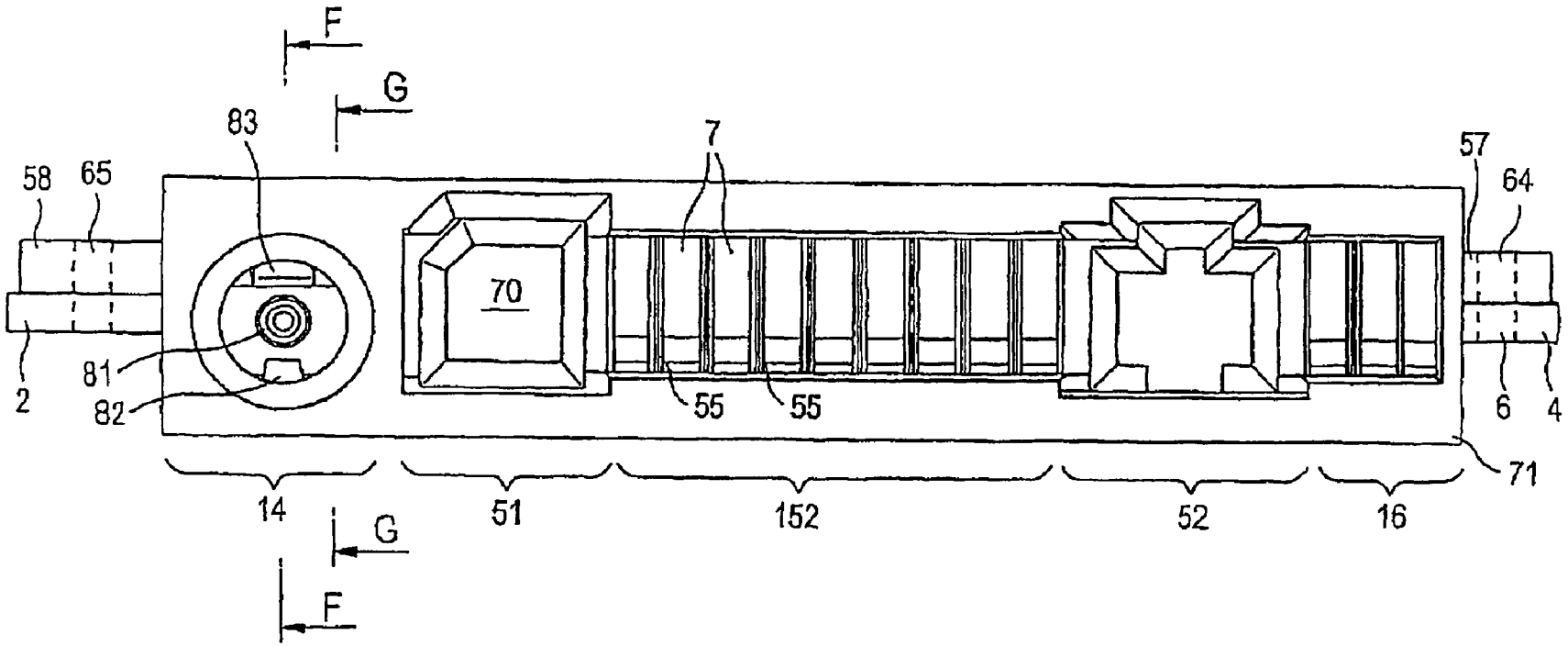
FIG. 6: a front view of a special mode of realization of the connector in accordance with the invention.

FIG. 8 represents a section along the line F—F of the connector of FIG. 6. This section passes exactly through the center of the power module 14. On this section, from top to bottom, is seen the holding contact 83, the center contact 81, and the second tongue 82*b* of the spring contact 82. The receiving chamber 93 of the holding contact 83 is visible in the upper third. This has a catch 83*a* turned downward that can block the complementary connector, which is not shown. In the middle third, the center contact 81 extends horizontally and, in the back zone 81*b*, it is provided with three sections 81*a*, 81*b*, and 81*c*. The leftmost section of these comes to be wedged in the second part 50. At the right and at the side is situated a block 88 that arises from the first pass. The lower edge is metallized and constitutes the end of the second lead 85, which is connected electrically to the connection face 5". The lower cylindrical zone of the block 88 is also metallized and constitutes the end of the first lead 84, which is connected to the connection face 5'.

The center contact 81 has an elongated form, corresponding to a symmetry of rotation, and has a smaller diameter in the zone in front 81*a* than in the zone in back 81*b*, which has at least one section 81*c* of spherical form, projecting toward the outside in order to ensure the electrical and mechanical connection of the center contact to the first band or lead 84.

Thus, the two right sections 81*c* are wedged in the interior of the block 88, causing them to establish contact with the first band or lead 84. The sections 81*c* of spherical form prevent a scraping of the metallic surface of the block 88 from occuring during the insertion of the center contact 81 into the chamber 91.

The spring contact 82 has two tongues 82*a* and 82*b*, the first tongue 82*a* establishing contact with the second band 85 and the second tongue 82*b* penetrating into the receiving chamber 78 of the complementary connector.

FIG. 9 represents a section along the line G—G of the connector of FIG. 6. The block 88 and the first tongue 82*a* coming from the spring contact 82 are thus represented in section. In the upper third is seen the holding contact passing through a window. Drawn below as a broken line is the center contact. The L-shaped block 88 that is present at this place emerges from the back face 14*b*. The first lead 84 is thus visible there in the form of a dark vertical line. The bottom face of the block 88 is metallized and constitutes, as already mentioned, the end of the second lead 85 with which the first tongue 82*a* enters into mechanical contact. The spring contact 82 is thus connected electrically to the connection face 5".

What is claimed is:

1. An input/output connector for surface mounting on a printed circuit card, comprising:

a first electrically insulating part, which has at least one fixing element with a planar face and at least one contact lead with a planar connection face, and a second part, which serves as housing and partially covers the first part, wherein the second part comprises an overmolded part which is overmolded on the first part, characterized in that the planar connection face is situated essentially in a same plane as the planar face of the fixing element, this same plane defining a plane for fixing the connector, and in that this contact lead comprises a metallization deposited on an insulating zone of the first part, and wherein a portion of the metallization extends between the first and second parts and is not covered by the second part.

2. The connector according to claim 1, further characterized in that the metallization includes a first portion made up of an electrical connection surface for the printed circuit card and a second portion oriented towards an exterior front of the connector and making up an electrical connection surface for a complementary connector, the first portion being continuous with the second portion.

3. The connector according to claim 1, further characterized in that the first part has, on the two faces of the connector, respectively, a fixing element in which is arranged, in each case, a centering hole.

4. The connector according to claim 1, further characterized in that the first part has at least one contact module, a module having at least one electrically conducting contact rib on which is deposited the metallization.

5. The connector according to claim 4, further characterized in that a module includes at least two contact ribs deposited parallel to one another, joined together mechanically by means of connecting elements of the first part, and electrically insulated by these connecting elements.

6. An input/output connector for surface mounting on a printed circuit card, comprising:

a first electrically insulating part, which has at least one fixing element with a planar face and at least one contact lead with a planar connection face, and and a second part, which serves as housing and partially covers the first part, characterized in that the planar connection face is situated essentially in the same plane as the planar face of the fixing element, this plane defining the plane for fixing the connector, and in that this contact lead corresponds to a metallization deposited on the insulating zone of the first part that is not covered by the second part, further characterized in that the first part has at least one contact module, a module having at least one electrically conducting contact rib on which is deposited the metallization, and further characterized in that the different contact ribs of a contact module are separated by shoulders belonging to the second part.

7. An input/output connector for surface mounting on a printed circuit card, comprising:

a first electrically insulating part, which has at least one fixing element with a planar face and at least one contact lead with a planar connection face, and and a second part, which serves as housing and partially covers the first part, characterized in that the planar connection face is situated essentially in the same plane as the planar face of the fixing element, this plane defining the plane for fixing the connector, and in that this contact lead corresponds to a metallization deposited on the insulating zone of the first part that is not covered by the second part, further characterized in that the second part consists of at least one locking module for ensuring a mechanical fixation of the complementary connector.

8. An input/output connector for surface mounting on a printed circuit card, comprising:

a first electrically insulating part, which has at least one fixing element with a planar face and at least one contact lead with a planar connection face, and and a second part, which serves as housing and partially covers the first part, characterized in that the planar connection face is situated essentially in the same plane as the planar face of the fixing element, this plane defining the plane for fixing the connector, and in that this contact lead corresponds to a metallization deposited on the insulating zone of the first part that is not covered by the second part, further characterized in that it includes a power module for the transmission of high electrical powers.

9. The connector according to claim 8, further characterized in that the power module consists of a metallic center contact, a metallic spring contact, and a holding contact, the contacts being capable of electrical connection to a printed circuit card by means of bands of metallized synthetic material.

10. The connector according to claim 9, further characterized in that the two bands of synthetic material, extending over the back face of the connector and belonging to the first part, become the separated connection faces, situated in the same plane as the connection faces of the rigid contacts.

11. The connector according to claim 9, further characterized in that the center contact of elongated form, corresponding to a symmetry of rotation, has a smaller diameter in the zone in front than in the zone in back, which has at least one section of spherical form, projecting toward the outside in order to ensure the electrical and mechanical connection of the center contact to the first band or lead.

12. The connector according to claim 9, further characterized in that the spring contact has two tongues, the first tongue establishing contact with the second band and the second tongue penetrating into the receiving chamber of the complementary connector.

13. An input/output connector for surface mounting on a printed circuit card, comprising:

a first electrically insulating part which has at least one fixing element with a planar face and at least one contact lead having a planar connection face, wherein the planar connection face and the planar face of the fixing element are situated essentially in a same plane defining the plane for fixing the connector to the printed circuit card, and an overmolded second part partially molded on the first part so as to form a mask defining an activated accessible zone on the first part, wherein the contact lead comprises metallization deposited on the activated accessible zone of the first insulating part.

14. An input/output connector for surface mounting on a printed circuit card as in claim 13 further characterized in that different contact ribs of a contact module of the first part are separated by shoulders belonging to the second part.

15. An input/output connector for surface mounting on a printed circuit card as in claim 13 further characterized in that the second part comprises at least one locking module for ensuring a mechanical fixation of a complementary connector.

16. An input/output connector for surface mounting on a printed circuit card as in claim 13 further characterized in that it includes a power module for the transmission of high electrical powers.

* * * * *